US005479690A

United States Patent [19]

Hall, Jr.

[11] Patent Number: 5,479,690

[45] Date of Patent: Jan. 2, 1996

[54] TUBE MAKING MECHANISM HAVING A FILL TUBE FOR DEPOSITING A CERAMIC POWDER INTO THE TUBE AS IT IS BEING MADE

[75] Inventor: Bertie F. Hall, Jr., Ann Arbor, Mich.

[73] Assignee: Hoskins Manufacturing Company, Detroit, Mich.

[21] Appl. No.: 160,951

[22] Filed: Dec. 1, 1993

[51] Int. Cl.[6] ..... H01B 13/26

[52] U.S. Cl. ..... 29/33 R; 29/33 D

[58] Field of Search ..... 29/33 R, 33 D, 29/33 T; 228/166

[56] References Cited

U.S. PATENT DOCUMENTS

| | | | |
|---|---|---|---|
| 4,269,639 | 5/1981 | Lewis | 156/54 |
| 4,437,914 | 3/1984 | Frischen | 228/166 X |
| 4,512,827 | 4/1985 | Gill | 156/48 |
| 4,629,110 | 12/1986 | Holmgren et al. | 228/148 |
| 5,122,209 | 6/1992 | Moore et al. | 156/54 |

FOREIGN PATENT DOCUMENTS 9014671 11/1990 WIPO .

*Primary Examiner*—Z. R. Bilinsky
*Attorney, Agent, or Firm*—Brooks & Kushman

[57] ABSTRACT

A fill tube for filling a seam-welded tube with a ceramic powder as the seam-welded tube is being made by a tube making mechanism. The fill tube has a guide tube for directing the ceramic powder from a location upstream of a seam welder to a location downstream of the seam welder. A mounting bracket is attached to the upper end of the guide tube and has a powder channel directing the ceramic powder received from an external powder source into the guide tube and a wire channel directing wires received from an external source into the guide tube. A wire guide is disposed at the opposite end of the guide tube which locates the wires in the seam-welded tube as it is being filled with the ceramic powder.

21 Claims, 1 Drawing Sheet

TUBE MAKING MECHANISM HAVING A FILL TUBE FOR DEPOSITING A CERAMIC POWDER INTO THE TUBE AS IT IS BEING MADE

TECHNICAL FIELD

The invention is related to tube making mechanisms for making seam-welded tubing from flat metal strips and, in particular, to a fill tube for filling the seam-welded tubing with a ceramic powder as it is being made by the tube making mechanism.

BACKGROUND ART

Mineral or ceramic powder-filled, metal-sheathed cables and mechanisms for making them are well known in the art. Thompson, in PCT patent application PCT/AU90/00198, teaches the extruding of a mixture of a ceramic powder and binder onto a conductor, then enclosing the wire and ceramic powder in a metal sheath after the binder is removed by heating. In the alternative, Moore et al, in U.S. Pat. No. 5,122,209, teaches a mechanism for applying a metal sheath about a plurality of conductive wires having insulating jackets. A spring steel strip is used to displace the wires away from the region where the metal sheath is welded.

Holmgien et al, in U.S. Pat. No. 4,629,110, teaches a method for making powder-filled tubular welding electrodes. A pressurized gas is introduced into the filling conduit and is evacuated by a cylindrical duct formed between the filling tube and the welded tube.

Gill, in U.S. Pat. No. 4,512,827, teaches a fill tube for filling a seam-welded tube with a powdered insulating material. The fill tube has a pair of vertical tubular wire guides which extend the length of the fill tube. The fill tube also has a longitudinal gas delivery tube provided along one edge of the fill tube which is used to deliver argon gas to the weld area to prevent contamination of the weld.

Lewis, in U.S. Pat. No. 4,269,639, also teaches a mechanism for making mineral insulated cables. Like Gill, the fill tube taught by Lewis has a pair of tubular wire guides which extend downstream of the end of the powder fill tube and are aligned within the metal sheath by at least one spacer. One of the tubular wire guides and the powder fill tube have an elongated aperture through which an inert gas is emitted between the powder fill tube and the metal sheath in the vicinity of the weld.

What is needed is a fill tube which eliminates the tubular wire guide and eliminates the requirement of providing an inert gas between the powder fill tube and the metal sheath in the vicinity of the location where the weld is being made.

SUMMARY OF THE INVENTION

The invention is a tube making mechanism having a fill tube for filling the tube with a ceramic insulating powder as the tube is being made. The tube making mechanism is of the type having rolls for forming a continuous flat metal strip into a cylindrical form and a seam welder for welding the longitudinal edges of the cylindrically formed metal strip to each other to continuously produce seam-welded tubing. The fill tube comprises a guide tube for depositing the ceramic powder in the seam-welded tube downstream of the seam welder. The guide tube has a diameter smaller than the internal diameter of the seam-welded tubing being made, a powder input end and a powder exit end.

The guide tube extends into the seam-welded tube from a location upstream of the seam welder to a location downstream of the seam welder selected to prevent airborne ceramic powder, generated at the powder exit end of the guide tube from contaminating the weld.

A mounting bracket is attached to the guide tube at the powder input end and has at least a powder fill channel directing powder received from an external source into the guide tube. The seam guide of the tube making mechanism extends into the cylindrically formed metal strip and displaces the guide tube in a direction away from the seam welder to prevent damage to the guide tube from the heat generated by the seam welder.

In the preferred embodiment, the mounting bracket also has a wire channel for directing one or more wires received from an external wire source into the guide tube and a wire guide attached to the output end of the guide tube to position the wire or wires inside the seam welded tube relative to each other and to the internal surface of the seam-welded tube. The position of the wires being held in place by the deposited ceramic powder as the seam-welded tube is being made.

One advantage of the fill tube is that the exit end of the guide tube is extended past the zone of the welding arc a distance sufficient to avoid contamination of the weld by airborne particles.

Another advantage is that the guide tube is displaced away from the seam to be welded in the vicinity of the seam welder, thus preventing weld heat from damaging and/or warping the guide tube.

Yet another advantage is that the seam guide, in addition to aligning the edges of the metal strip, also displaces the guide tube away from the welding.

These and other advantages will become more apparent from a reading of the specification in conjunction with the drawings.

DETAILED DESCRIPTION OF THE PREFERRED EMBODIMENT(S)

Figures 1, 2, 3, 4, 5, 6, 7:
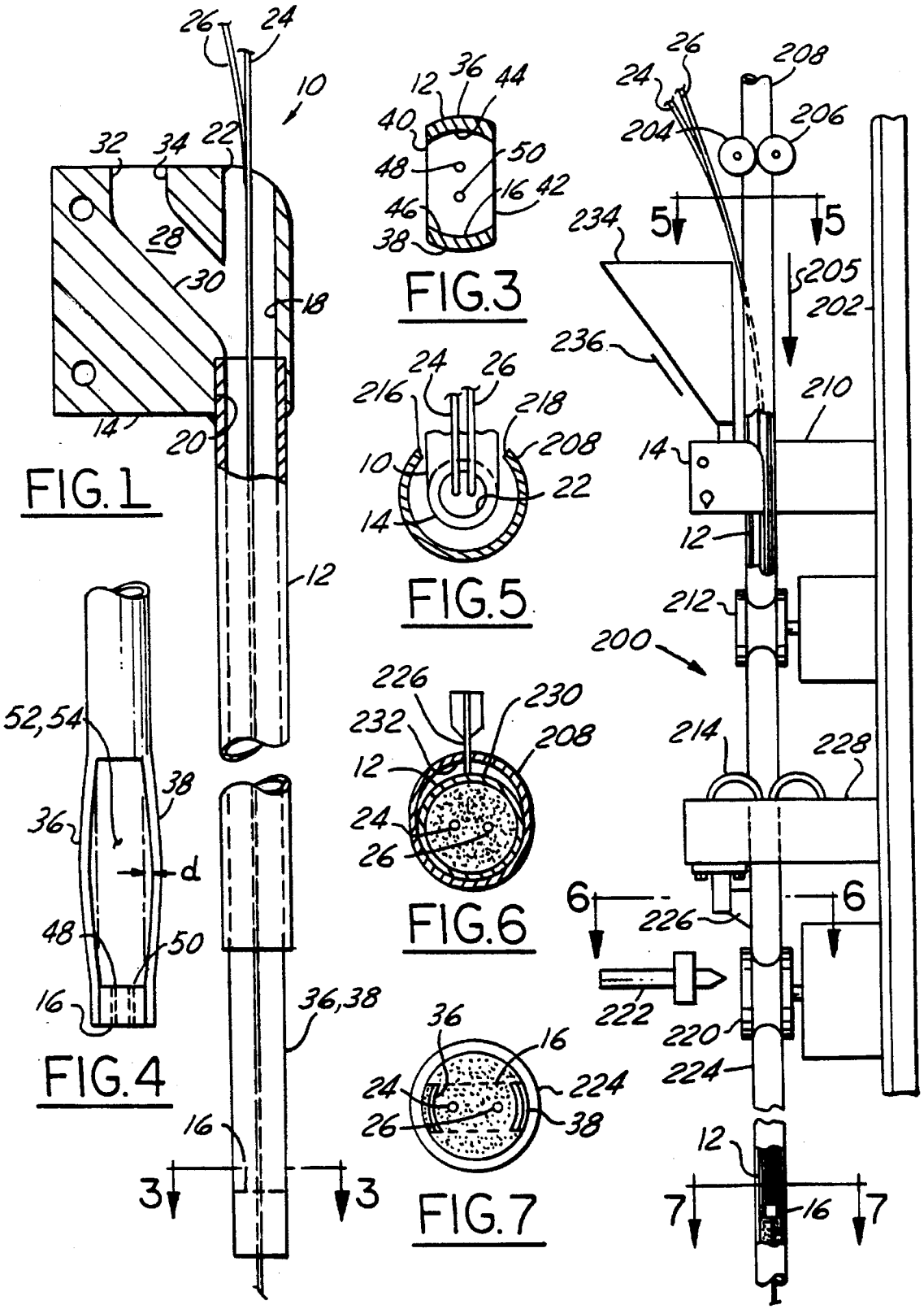
FIG. 1 is a side view of the fill tube.
FIG. 2 is a side view of a portion of the tube-making mechanism.
FIG. 3 is a cross-sectional view taken along section line 3—3 of FIG. 1.
FIG. 4 is a front view of the lower portion of the fill tube.
FIG. 5 is a cross-sectional view taken along section line 5—5 of FIG. 2.
FIG. 6 is a cross-sectional view taken along section line 6—6 of FIG. 2.
FIG. 7 is a cross-sectional view taken along section line 7—7 of FIG. 2.

FIG. 1 shows the details of a fill tube 10 for filling a seam-welded tube with a ceramic powder as the tube is being formed by a tube-making mechanism. The fill tube 10 comprises a guide tube 12 attached at its upper end to a mounting bracket 14 and at its lower end to a wire guide 16. The mounting bracket 14 has a wire channel in the form of a throughbore 18 having at its lower end a counterbore 20 in which is received the upper end of the guide tube 12.

The upper end of the guide tube 12 may be welded to the mounting bracket 14 to rigidly attach the tube 12 to the mounting bracket 14, may be threadably received in counterbore 20, may be shrunk fit into the counterbore 20, or may be attached thereto using any type of attachment mechanism known in the art.

The diameter of the wire channel 18 is preferably equal to the internal diameter of guide tube 12. The upper end of wire channel 18 forms a wire entrance port 22 through which wires, such as wires 24 and 26 from an external source are received. The mounting bracket 14 also has powder fill channel 28 which, at its internal end 30, connects to the wire channel 18. The powder fill channel 28 is angularly disposed with respect to the wire channel 18 and terminates at its upper end in a powder fill aperture 32. Preferably, the powder fill channel 28 is disposed at a 45° angle relative to the wire channel 18 and has a diameter substantially equal to the diameter of the wire channel 18. The powder fill channel 28 may have a vertical portion 34 adjacent to the powder fill aperture 32 which is parallel to the longitudinal axis of the guide tube 12.

The lower end of the guide tube 12 has a pair of legs 36 and 38, the terminal ends of which are attached to the wire guide 16, as shown in FIGS. 1, 3 and 4.

Referring to FIG. 3, the sides 40 and 42 of the wire guide 16 are substantially flat and parallel to each other, while the ends 44 and 46 have an arcuate contour mating with the internal surfaces of the legs 36 and 38. The wire guide 16 also has a pair of spatially separated guide apertures 48 and 50 through which are received the wires 24 and 26, respectively. The guide apertures 48 and 50 locate the wires 24 and 26 within the tube after the seam of the tube being formed has been welded and is filled with the ceramic powder.

As shown in FIG. 4, the legs 36 and 38 are bowed outwardly a distance "d" selected to cause them to slidingly engage the internal surface of the tube after the tube has been welded. The bowed legs 36 and 38 centrally locate the wire guide 16 in the tube and thereby locate the wires 24 and 26 such that the wires 24 and 26 are separated from each other and from the internal walls of the welded tube by desired distances.

The legs 36 and 38 and wire guide 16 form two powder exit slots 52 and 54 at the terminal end of the guide tube 12. The powder exit slots 52 and 54 permit the ceramic powder received through the powder fill aperture 32 to be deposited into the seam welded tube at a desired location downstream of the point at which the tube is welded. Preferably, the exit slots 52 and 54 are approximately 1½ inches long.

Referring to FIG. 2, there is shown the installation of the fill tube 10 on a tube making mechanism 200. The tube making mechanism has a vertical frame 202 and a set of tube forming rolls attached to the frame 202, indicated by rolls 204 and 206. The set of tube forming rolls shape a flat metal strip 208 into a semi-cylindrical form. Rolls 204 and 206 are the last set of rolls of 5 or more sets of tube forming rolls, as is known in the art. The flat metal strip 208 passes through the tube forming rolls in a direction indicated by arrow 205. As it exits rolls 204 and 206, the metal strip 208 has a semi-cylindrical or "C" shape open at one end as shown in FIG. 5. The fill tube 10 is disposed along the path of the shaped metal strip 208 downstream of the tube forming rolls 204 and 206 with the guide tube 12 inside the cylindrically-shaped metal strip 208. The mounting bracket 14 of the fill tube 10 is bolted to a support member 210 rigidly connecting the fill tube 10 to the frame 202 of the tube making mechanism 200.

Downstream of the mounting bracket 14, the metal strip 208 is further shaped by sets of rolls 212 and 214 and finally the longitudinal edges 216 and 218 of shaped metal strip 208 are brought into contact with each other by a set of closing rolls 220, completing the shaping of the metal strip into a tubular form with the guide tube 12 enclosed therein.

A seam welder 222 welds the longitudinal edges 216 and 218 of the formed metal strip 208 to each other adjacent to the closing rolls 220, producing a seam-welded metal tube 224. A seam guide 226 upstream of the set of closing rolls 220 align the edges 216 and 218 of the metal strip 208 with the seam welder 222 to assure that the seam formed by the edges 216 and 218 will be properly welded to each other by the seam welder 222. The seam guide 226 may be attached to a support member 228 which supports the set of forming rolls 214, as shown in FIG. 2, or may have a separate support member, not shown, which fixedly attaches the seam guide 226 to the frame 202 of the tube making mechanism.

As shown more clearly in FIG. 6, the formed metal strip 208 between the rolls 214 and the closing rolls 220 has an oval cross-section, the major axis of which is substantially aligned with the seam guide 226. A portion of the seam guide 226 extends inside the formed metal strip and engages the external surface 230 of the guide tube 12. The portion of the seam guide 226 inside the formed metal strip displaces the guide tube 12 against the internal surface of the formed metal strip 208 opposite the edges 216 and 218. This displacement of the guide tube 12 produces a gap between the internal surface 232 of the formed metal strip 208 and the external surface 230 of the guide tube 12 in the immediate vicinity of the seam welder 222. This permits the edges 216 and 218 to be welded to each other without damage to the guide tube 12 and inhibits direct contact of the guide tube 12 with the formed metal sheet 208 in the vicinity of the weld which would otherwise affect the quality of the weld.

The guide tube 12 extends inside the seam welded tube 224 downstream of the seam welder 222 for a distance at least 15 times the inside diameter of the seam welded tube 224. This distance has been found to be sufficient to prevent airborne powder produced at the downstream end of the fill tube 10 to be carried into the vicinity of the seam welder 222. By preventing the airborne powder from rising to the vicinity of the seam welder 222, it also prevents the powder from adhering to the internal surface of weld metal before it has had time to cool or contaminate the weld metal reducing the strength and quality of the weld.

The ceramic powder used to fill the seam-welded tube 224 is guided into the fill tube 10 by a funnel-shaped hopper 234. The hopper 234 has a reduced diameter outlet which is received in the powder fill aperture 32 of the mounting bracket 14. The ceramic powder is gravity fed into the guide tube 12 and at least one vibrator, such as vibrator 236, may be used to facilitate the flow of the ceramic powder into the fill tube 10.

The ceramic powder from the hopper 234 flows through powder fill channel 28, the guide tube 12, and exits the guide tube 12 at a distance of at least 15 internal diameters of the seam-welded tube 224 below the seam welder 222. The ceramic powder exits the guide tube 12 through exit slots 52 and 54 provided at its terminal end of the guide tube 12 as shown in FIGS. 3 and 4. The bowed legs 36 and 38 provided at the terminal end of the guide tube 12 slidingly engage the internal walls of the seam-welded tube 224 centrally locating the wire guide 16 therein, as shown in FIG. 7.

As the wires 24 and 26 exit the wire guide 16, the ceramic powder exiting the exit slots 52 and 54 flow around the wires 24 and 26 securing them in place within the seam welded tube 224.

The wires 24 and 26 are received from separate wire spools (not shown) and are threaded through the wire entrance port 22 of the mounting head 14 as shown in FIG. 1. The wires 24 and 26 pass through the guide tube 12 and pass through guide apertures 48 and 50 respectively and are carried along with the seam welded tube 224 as it passes out of the tube making mechanism 200.

Although the wire guide 16 illustrated in FIG. 3 has two guide apertures 48 and 50, it is to be understood that the number of guide apertures is not limited to two guide apertures. As is known in the art, some embodiments of the seam welded tube may only have a single coaxial wire or may have three or more wires. Therefore, the wire guide may have only a single guide aperture or more than two symmetrically arranged guide apertures, one for each of the wires being enclosed in the seam welded tube.

Having disclosed a preferred embodiment of the tube making mechanism having a fill tube for filling the tube with a ceramic powder as it is being made, it is recognized that those skilled in the art may make certain changes and improvements within the scope of the invention as set forth in the appended claims.

What is claimed:

1. A tube making mechanism comprising:

a substantially vertical frame;

a plurality of forming rolls attached to said frame for forming a flat metal strip into a semi-cylindrical form in which the longitudinal edges of said metal are separated from each other;

a set of seam closing rolls attached to said frame downstream of said forming rolls to close said longitudinal edges of said metal strip to each other;

a seam welder attached to-said frame adjacent to said closing rolls for welding said adjacent longitudinal edges of said metal strip to each other to make a seam welded tube;

a fill tube attached to said frame for depositing a ceramic powder received from an external source into said seam welded tube, said fill tube having a mounting bracket attached to said frame upstream of said seam welder, a guide tube attached to said mounting bracket, said guide tube extending into said seam welded tube downstream of said seam welder a distance selected to prevent contamination of a weld made by said seam welder by airborne ceramic powder deposited in seam-welded tube by said fill tube, said mounting bracket having a powder fill channel directing said ceramic powder received from said external source into said guide tube; and a seam guide attached to said frame for aligning said longitudinal edges of said metal strip with said seam welder upstream of said closing rolls, said seam guide extending into said metal strip in said cylindrical form a distance sufficient to displace said fill tube in the vicinity of said seam welder away from said seam welder to inhibit damage to said fill tube by the welding of said longitudinal edges of said metal strip to each other.

2. The tube making mechanism of claim 1 wherein said mounting bracket further includes a wire channel directing at least one wire received from an external source into said guide tube and wherein said guide tube further includes a wire guide attached to an end of said guide tube received in said seam welded tube to locate the position of said at least one wire in said seam welded tube as it is being filled with said ceramic powder.

3. The tube making mechanism of claim 2 wherein said wire guide has a number of wire apertures provided therethrough equal in number to the number of wires received from said external source, said wire apertures positioning said wires in said seam welded tube at predetermined locations relative to each other and to the internal surface of said seam welded tube.

4. An arrangement for depositing ceramic powder into a seam welded tube as it is being made by a tube making mechanism, said tube making mechanism being of the type having rolls for forming a flat metal strip into a cylindrical form and a seam welder for welding the edges of the flat metal strip to each other to continuously form seam welded tubing, said arrangement comprising:

a fill tube for depositing the ceramic powder in said seam welded tube downstream of said seam welder, said fill tube having a powder input end and a powder exit end, said fill tube extending into said seam welded tube downstream of said seam welder a distance selected to prevent the air borne ceramic powder generated at said powder exit end as said ceramic powder is deposited in said seam welded tube, from contaminating the weld being made by said seam welder;

a mounting bracket attached to said fill tube at said powder input end, said mounting bracket having at least a powder fill channel directing ceramic powder received from an external source into said fill tube; and means for radially displacing said fill tube within said metal strip in said cylindrical form in a direction away from said seam welder to prevent damage to said fill tube by the heat generated by the welding of said edges of said metal strip to each other by said seam welder.

5. The arrangement of claim 4 wherein said distance selected to prevent said air borne ceramic powder from contaminating the weld is greater than 15 times said internal diameter of said seam welded tube.

6. The arrangement of claim 4 wherein said tube making mechanism has a seam guide upstream of said seam welder to align said edges of said cylindrically formed metal strip with said seam welder, said means for displacing comprising an extension of said seam guide internal to said metal strip in said cylindrical form which engages an external surface of said fill tube to displace it away from said seam welder.

7. The arrangement of claim 4 wherein said tube making mechanism has means for inserting at least one wire into said seam welded tube as it is being made, said mounting bracket further including a wire channel for guiding said at least one wire into said fill tube, and said fill tube further having a wire guide attached to said powder exit end to locate the position of said at least one wire in said seam welded tube downstream of said seam welder.

8. The arrangement of claim 7 wherein said wire channel and powder fill channel are united within said mounting bracket to form a single channel prior to said fill tube.

9. The arrangement of claim 8 wherein said fill tube has a longitudinal axis, said wire channel is a throughbore concentric with said longitudinal axis and said powder fill channel is angularly disposed to said throughbore so as to intersect said throughbore prior to said fill tube.

10. The arrangement of claim 8 wherein said powder fill channel is disposed at approximately 45° relative to said wire channel.

11. The arrangement of claim 9 wherein said wire channel and said powder fill channel have approximately the same diameter.

12. The arrangement of claim 7 wherein said fill tube has a pair of diametrically opposed legs provided at said powder exit end, and wherein said wire guide is attached to said pair of diametrically disposed legs.

13. The arrangement of claim 12 wherein said pair of diametrically opposed legs have a predetermined width, said wire guide having a width substantially equal to said predetermined width.

14. The arrangement of claim 12 wherein said legs are bowed outwardly to slidingly engage the internal surface of said seam welded tube.

15. The arrangement of claim 13 wherein said means for inserting at least one wire into said seam welded tube inserts a plurality of wires into said seam-weld tube said wire guide having a plurality of through wire apertures equal in number to said plurality of wires, each wire aperture of said plurality of wire apertures receiving a respective one of said plurality of wires, said plurality of wire apertures defining the desired location of each wire of said plurality of wires inside said seam-welded tube.

16. The arrangement of claim 6 wherein said metal strip in said cylinder form has an oval cross-section in the vicinity of said seam guide and wherein said oval cross-section has a major axis parallel to said seam guide, said extension of said seam guide having a length selected to displace said fill tube to engage said metal strip in said cylindrical form at a location opposite said seam guide.

17. An apparatus for depositing ceramic powder into a cylindrical tube having a welded seam as it is being made from a metal strip by a tube making mechanism, said apparatus comprising:

a guide tube for depositing the ceramic powder into the cylindrical tube downstream of the welding of said welded seam, said guide tube having a powder input end and a powder exit end, said powder exit end having a pair of diametrically opposed slots separated by a pair of diametrically opposed legs;

a mounting bracket attached to said guide tube at said powder input end, said mounting bracket having at least a powder fill channel for directing ceramic powder received form an external source into said guide tube and a wire channel for directing at least one wire received from an external source into said guide tube; and a wire guide attached to the terminal ends of said diametrically opposed legs, said wire guide locating said at least one wire at a desired location within the cylindrical tube as it is being filled with said ceramic powder received from said external source.

18. The fill tube of claim 17 wherein said pair of diametrically opposed legs are bowed outwardly to slidingly engage the internal surfaces of said cylindrical tube to center said powder exit end of said guide tube therein.

19. The fill tube of claim 17 wherein said wire guide has flat sides forming a continuation of said pair of diametrically opposed slots at the powder exit end of said guide tube.

20. The fill tube of claim 19 wherein said wire guide has at least one wire aperture receiving said at least one wire therethrough to positively locate said wire in said cylindrical tube as it is being formed.

21. The fill tube of claim 17 wherein said guide tube has an axis, said wire channel is coaxial with said axis of said guide tube and said powder fill channel is angularly disposed to said wire channel.

* * * * *